US007600890B2

(12) United States Patent
Swantner et al.

(10) Patent No.: US 7,600,890 B2
(45) Date of Patent: Oct. 13, 2009

(54) ILLUMINATED SIGN AND LIGHT SOURCE FOR USE WITH SAID SIGN

(75) Inventors: Michael J. Swantner, Saxonburg, PA (US); Douglas G. Seymour, York, PA (US)

(73) Assignee: Osram Sylvania Inc., Danvers, MA (US)

( * ) Notice: Subject to any disclaimer, the term of this patent is extended or adjusted under 35 U.S.C. 154(b) by 98 days.

(21) Appl. No.: 11/519,660

(22) Filed: Sep. 12, 2006

(65) Prior Publication Data

US 2008/0062697 A1 Mar. 13, 2008

(51) Int. Cl.
*F21S 9/00* (2006.01)

(52) U.S. Cl. ..... 362/228; 362/800; 362/373; 362/249; 362/294; 362/345; 362/545; 362/611; 362/612; 362/613; 257/88; 257/99; 250/239

(58) Field of Classification Search ..... None
See application file for complete search history.

(56) References Cited

U.S. PATENT DOCUMENTS

| | | | | |
|---|---|---|---|---|
| 6,343,871 | B1 * | 2/2002 | Yu | 362/250 |
| 6,746,885 | B2 * | 6/2004 | Cao | 438/26 |
| 6,827,469 | B2 * | 12/2004 | Coushaine et al. | 362/294 |
| 7,086,767 | B2 * | 8/2006 | Sidwell et al. | 362/545 |
| 2004/0213014 | A1 * | 10/2004 | Koike | 362/545 |
| 2004/0223338 | A1 * | 11/2004 | Koike et al. | 362/545 |
| 2006/0214179 | A1 * | 9/2006 | Cao | 257/99 |
| 2006/0245209 | A1 * | 11/2006 | Jeong et al. | 362/612 |

* cited by examiner

*Primary Examiner*—Sandra L O'Shea
*Assistant Examiner*—Danielle Allen
(74) *Attorney, Agent, or Firm*—William H. McNeill

(57) ABSTRACT

An illuminable sign (20) has a base (22); a trough (24) having a configuration C formed in the base (22); a light dispensing medium (26) having the configuration C fitted in the trough (24) and including a pair of light-entering ports (28, 30); a light generator (32) fixed in operative relation between the pair of light-entering ports (28, 30), the light generator (32) including at least one light source (34); and a cover (36) fitted to the base.

6 Claims, 3 Drawing Sheets

ILLUMINATED SIGN AND LIGHT SOURCE FOR USE WITH SAID SIGN

TECHNICAL FIELD

This application relates generally to illumination devices and more particularly to illuminated signs. Still more particularly it relates to a light source for use with such signs.

BACKGROUND ART

The use of illuminated signs for advertising purposes is well known. The most prevalent light sources employed for the illumination have been incandescent bulbs or neon bulbs. Each type has distinct advantages; however, they also suffer from disadvantages related to, for example, short life spans, fragility, difficulty in replacing specific units, etc. Some of these disadvantages have been reduced by a switch to solid-state light sources, such as light emitting diodes (LED or LEDs); however, replacement of such devices has remained a problem area.

Accordingly, it would be a decided advantage to provide an illuminable sign that had a long life, ruggedness, good weathering characteristics, and ease of replacement of the light source in the event such action became necessary.

DISCLOSURE OF INVENTION

It is, therefore, an object of the invention to obviate the disadvantages of the prior art.

It is another object of the invention to enhance illuminable signs.

These objects are accomplished, in one aspect of the invention by the provision of an illuminated sign comprising: a base; a trough having a configuration formed in said base; a light dispensing medium having said configuration fitted in said trough and including a pair of light-entering ports; a replaceable light generator fixed in operative relation between said pair of light-entering ports, said light generator including at least one light source for each light-entering port; and a cover fitted to said base.

BRIEF DESCRIPTION OF THE DRAWINGS

FIG. 3 is a sectional view taken along the line 3-3 of FIG. 1;

BEST MODE FOR CARRYING OUT THE INVENTION

For a better understanding of the present invention, together with other and further objects, advantages and capabilities thereof, reference is made to the following disclosure and appended claims taken in conjunction with the above-described drawings.

Figure 1:
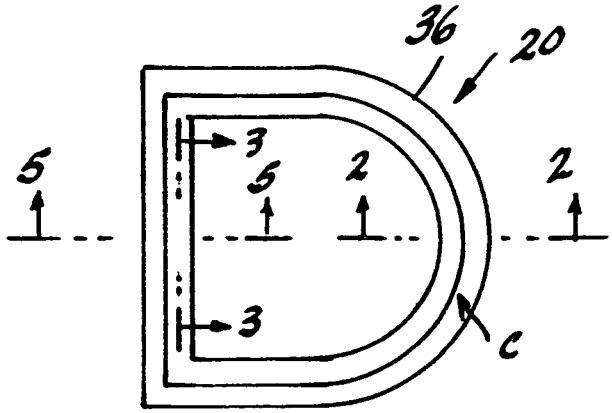
FIG. 1 is a plan view of an embodiment of the invention.

Referring now to the drawings with greater particularity, there is shown in FIG. 1 an illuminated sign 20 comprising a base 22; a trough 24 (FIG. 2) having a configuration C formed in the base 22; a light dispensing medium 26 (FIG. 3) having the same configuration C fitted in the trough 24 and including a pair of light-entering ports 28, 30 (FIG. 3); a replaceable light generator 32 (FIGS. 3 and 4) fixed in operative relation between the pair of light-entering ports 28, 30, the light generator 32 including at least one light source 34, preferably a light emitting diode; and a cover 36 fitted to the base.

Preferably, the base 22 is formed from an opaque ABS plastic for strength and low cost, while the cover 36 is a translucent acrylic for light transmission and UV stability. It can be clear or colored as desired; for example, to generate a particular color from a white light-emitting source or to enhance or modify the color emitted from a colored light-emitting source.

The configuration C can be an abstract design or an intelligence-displaying figure such, for example, as an alphanumeric. In the specific embodiment shown the configuration takes the form of the letter "D".

The light dispensing medium 26 comprises an acrylic rod 27 having an upper surface 38 and a bottom surface 40, the bottom surface 40 being in contact with the trough 24 and having lens forming striations 42 formed therein. The depths of the striations 42 can be varied to allow for customized light output. The spacing of the striations is set to a maximum distance before dark areas appear on the cap or cover 36. The spacing thus is dependent upon the diffusion of light through the rod 27, the distance between rod and the cover and, of course, the light transmissive properties of the cover material.

Figure 4:
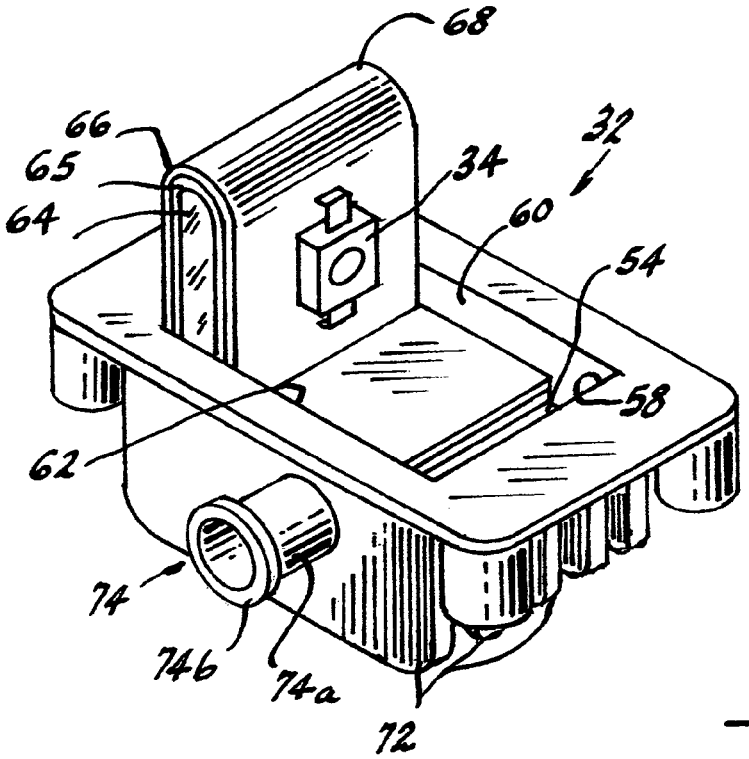
FIG. 4 is a perspective view of a light generator in accordance with an aspect of the invention.

The light generator 32 is shown most clearly in FIG. 4 and comprises a thermally conducting housing 52 that not only supports the light source but also additionally functions as a heat sink. A suitable material is die-cast zinc. The housing 52 has a bottom 54 surrounded by upstanding walls 56, 58, 60, 62. In the embodiment shown in FIG. 4 a projection 64 is formed adjacent one of the walls, for example, wall 56. An electrically conductive member 66 is fitted with the housing 52, the electrically conductive member 66 having a U-shaped portion 68 fitted over the projection 64 and a planar section 70 extending normal to the U-shaped 68 section fitted in the bottom 54. A preferred material for the electrically conductive material is copper. Two light sources 34, such as LEDs, are provided, one each operatively positioned on each leg of the U-shaped portion 68. A dielectric layer 65 is positioned between the electrically conductive member 66 and the housing 52.

In an alternate embodiment, a plurality of LEDs 34 can be mounted upon circuitry formed on the bottom 54 and the light dispensing medium can be formed with a cylindrical projection that resides within the cavity formed by the bottom 54 and the walls 56, 58, 60 62 and captures the light from the LEDs.

Since the housing 52 also functions as the heat sink for the LEDs, it is provided with a plurality of heat-radiating fins 72.

One of the walls of the housing 52, for example, wall 62, is provided with a wire inlet 74 in the form a tubular projection 74*a* having a lip 74*b* formed on edge. The lip 74*b* aids in sealing the connecting wires for the LEDs (not shown) in an environmental manner when a heat shrink tubing (not shown) is employed to fix the wires in position. The heat shrink tubing, when applied, also provides some strain relief.

At least one of the walls and preferably at least two oppositely disposed walls, such as walls 56, 58, includes a mounting flange 76 provided with mounting means 76*a*, for receiving, for example, self-threading screws 76*b*.

Figure 2:
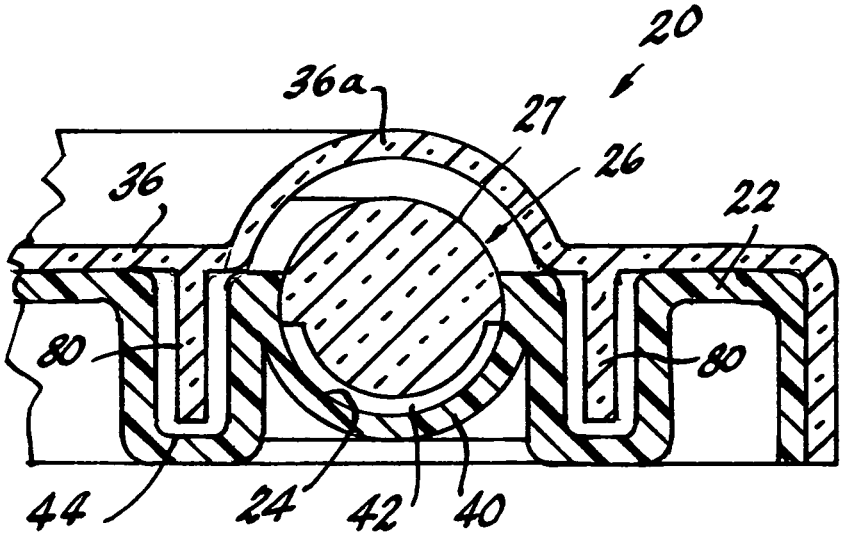
FIG. 2 is a sectional view taken along the line 2-2 of FIG. 1.
Figure 2:
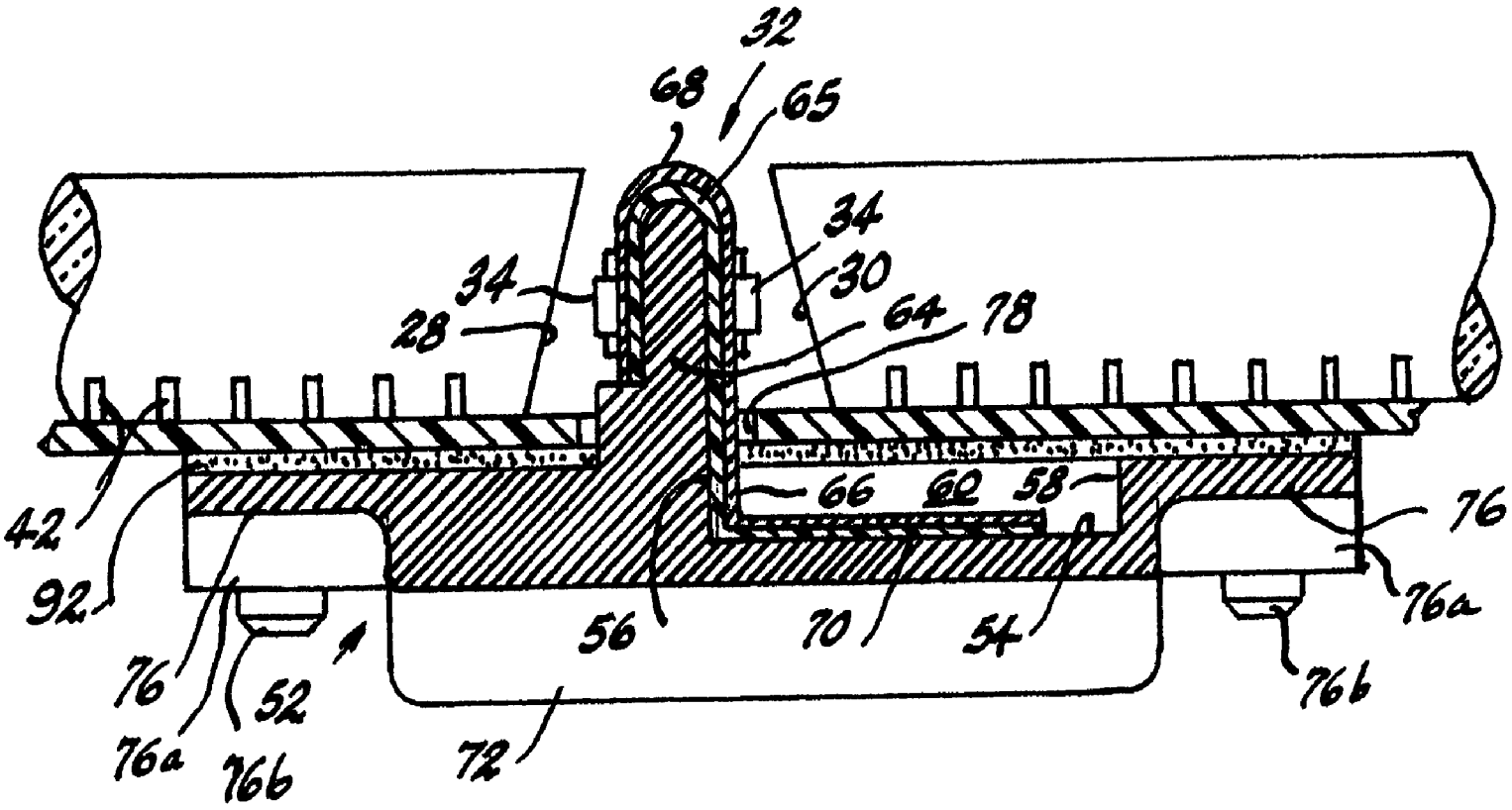
Figure 5:
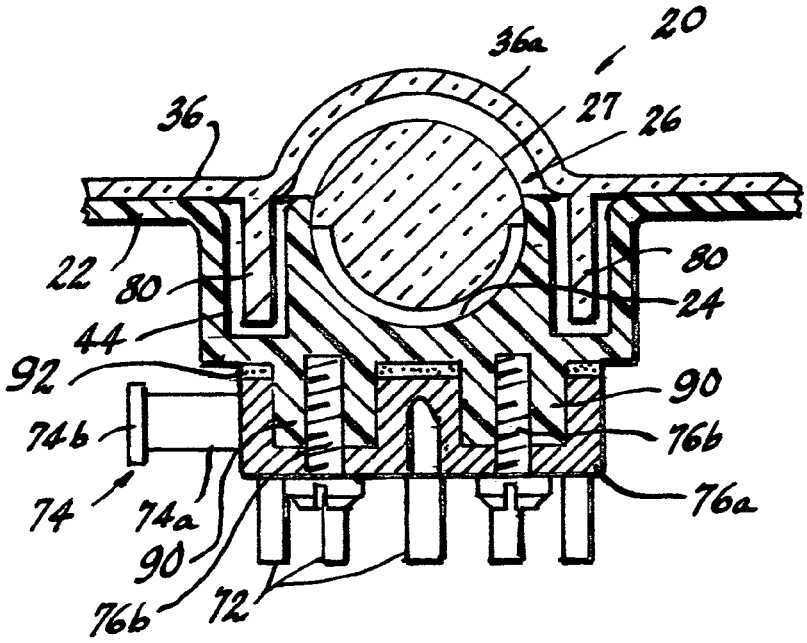
FIG. 5 is a sectional view taken along the line 5-5 of FIG. 1.

The trough 24 in the base 22 is semi-circular in cross-section and extends for a radial distance the is more than ½ the radial distance of the light dispensing medium 26 which is circular in cross-section. The extended distance provides an undercut that firmly maintains the light-dispensing medium 26 within the trough 24. This feature is shown in FIGS. 2 and 5.

The trough 24 is surrounded on both sides by channel 44 that is formed to receive ribs 80 that project from the underside of the cover 36, i.e., the side of the cover that will face the top surface of the base 22. The cover 36 additionally has a formed projection 36*a* that matches the configuration C.

The base 22 has an opening 78 therein to receive the light generator 32. Specifically, in the embodiment shown, the opening 78 is a rectangular slit that is formed to receive the projection 64 of the light generator 32, which carries the electrically conductive member 66 and the LEDs 34. When properly positioned within the opening 78 the LEDs 34 are aligned, respectively, with the light-entering ports 28, 30.

Projections 90, formed on the underside of the base 22 are engaged by the mounting means 76*a* formed with the light generator housing 52 to provide a positive stop feature and assure proper alignment of the LEDs 34 with the light-entering ports 28, 30. When the self-threading screws 76*b* are inserted through the housing 52 and into the projections 90 on base 22 the assembly is complete. The stop feature additionally provides for consistent compression on the sealing gasket 92 that is placed between the housing 52 and the base 22.

Because the light generator 32 is replaceably located with the backside of the base 22, the cover 36 can be permanently sealed to the base 22, as by the application of a suitable adhesive between the ribs 80 and the walls of the channel 44.

Thus there is provided an illuminable sign that has a long life, ruggedness, good weathering characteristics, and ease of replacement of the light source in the event such action becomes necessary.

While there have been shown and described what are at present considered to be the preferred embodiments of the invention, it will be apparent to those skilled in the art that various changes and modifications can be made herein without departing from the scope of the invention as defined by the appended claims.

What is claimed is:

1. A light generator comprising:

a thermally conducting housing having a bottom surrounded by upstanding walls, said bottom extending in a first direction;

a projection adjacent one of said walls and extending orthogonal to said first direction;

an electrically conductive member fitted with said housing, said electrically conductive member having a U-shaped portion fitted over said projection and a planar section extending normal to said U-shaped section and parallel to said bottom and fitted in said bottom;

a dielectric layer positioned between said housing and said electrically conductive member; and two light sources, one each operatively positioned on each leg of said U-shaped portion.

2. The light generator of claim 1 wherein said light sources are light emitting diodes.

3. The light generator of claim 2 wherein said housing is provided with a plurality of heat-radiating fins.

4. The light generator of claim 3 wherein one of said walls is provided with a wire inlet.

5. The light generator of claim 1 wherein at least one of said walls includes a mounting flange.

6. The light generator of claim 5 wherein each of two, oppositely disposed walls includes a mounting flange.

* * * * *